US005648702A

United States Patent [19]

Choi et al.

[11] Patent Number: 5,648,702

[45] Date of Patent: Jul. 15, 1997

[54] DIMMING CONTROL CIRCUIT HAVING FEEDBACK FREQUENCY CONTROL

[75] Inventors: Nak-choon Choi; Kyung-ha Jee, both of Buchon, Rep. of Korea

[73] Assignee: Samsung Electronics Co., Ltd., Suwon, Rep. of Korea

[21] Appl. No.: 556,695

[22] Filed: Nov. 13, 1995

[30] Foreign Application Priority Data

Dec. 22, 1994 [KR] Rep. of Korea ..... 94-35976

[51] Int. Cl.[6] ..... H05B 37/02

[52] U.S. Cl. ..... 315/224; 315/307; 315/DIG. 4

[58] Field of Search ..... 315/307, 224, 315/244, DIG. 4, 308

[56] References Cited

U.S. PATENT DOCUMENTS 4,933,605 6/1990 Quazi et al. ..... 315/224

*Primary Examiner*—Benny Lee
*Assistant Examiner*—David Vu

[57] ABSTRACT

A feedback dimming control circuit for controlling the luminance of a plurality of lamps, the circuit comprising: a multiplier receiving and multiplying a feedback current and an input voltage, a first subtracter generating an error signal by subtracting an output voltage from the multiplier from a reference voltage, a second subtracter subtracting a signal responsive to the error signal from the input voltage, an oscillator generating a periodic signal in response to the output of the second subtracter; and a tank resonating in response to the periodic signal and generating the feedback current.

5 Claims, 3 Drawing Sheets

DIMMING CONTROL CIRCUIT HAVING FEEDBACK FREQUENCY CONTROL

BACKGROUND OF THE INVENTION

The present invention relates to a feedback dimming control circuit, and more particularly, to a feedback dimming control circuit employing a frequency control technique for obtaining electronic ballast.

As shown in FIG. 1, a dimming control circuit employing a conventional open loop dimming technique comprises an oscillator 10 generating an oscillating signal having frequency f; a tank 12 which resonates at oscillation frequency f to generate a power supply voltage (or current) directly depending on the level of an input voltage $V_{in}$; and, a lamp 14 driven by tank 12. A parallel RC combination of a dimming resistor $R_f$ and a capacitor $C_f$ is connected to oscillator 10. Oscillator 10 is controlled by adjusting the value of dimming resistor $R_d$ to determine oscillation frequency f. With this circuit arrangement, the power supply provided by tank 12 to operate lamp 14 is also dependent on the exact adjustment of oscillating frequency f, i.e., the value of dimming resistor $R_d$.

Unfortunately, the conventional dimming technique can not maintain a constant power supply output, and thus constant light luminance, in the face of fluctuations in input voltage $V_{in}$ or changes in the lamp load (e.g., a change in the number of lamps). Furthermore, proper dimming control can be lost in the foregoing circuit, such that desired luminance for a given environment cannot be maintained.

SUMMARY OF THE INVENTION

The present invention provides a feedback dimming control circuit capable of maintaining a constant light luminance over variations in the input voltage and in load conditions. A feedback circuit is used to maintain optimum control function.

To achieve this result and other benefits explained below, the present invention provides a feedback dimming control circuit for optimally controlling the luminance of a plurality of lamps comprising; multiplier receiving and multiplying a feedback current and an input voltage, a first subtracter generating an error signal by subtracting an output voltage from the multiplier from a reference voltage, a second subtracter subtracting a signal responsive to the error signal from the input voltage, an oscillator generating a periodic signal in response to the output of the second subtracter, and a tank resonating in response to the periodic signal and generating the feedback current.

In the above-described feedback dimming control circuit, the reference voltage ($V_{ref}$) applied to the first subtracter has a value equal to $n \times V_{ref}$, where n is the number of the plurality of lamps.

In another aspect, the present invention additionally comprises; a error signal amplifier receiving and amplifying the error signal from the first subtracter, and an inverter inverting the amplified error signal and providing a signal to the second subtracter.

In yet another aspect, the present invention additionally comprises; an adder summing an applied dimming current and the output current from the multiplier, wherein the first subtracter generates the error signal by subtracting an output voltage from the adder from a reference voltage.

In the above-described feedback dimming control circuit, the reference voltage ($V_{ref}$) applied to the first subtracter has a value equal to $n \times V_{ref}$, and the dimming current ($i_d$) applied to the adder has a value equal to $n \times i_d$, where n is the number of the plurality of lamps.

BRIEF DESCRIPTION OF THE DRAWINGS

The above advantages of the present invention will become more apparent upon consideration of preferred embodiments with reference to the attached drawings in which.

DETAILED DESCRIPTION OF THE INVENTION

Figure 1:
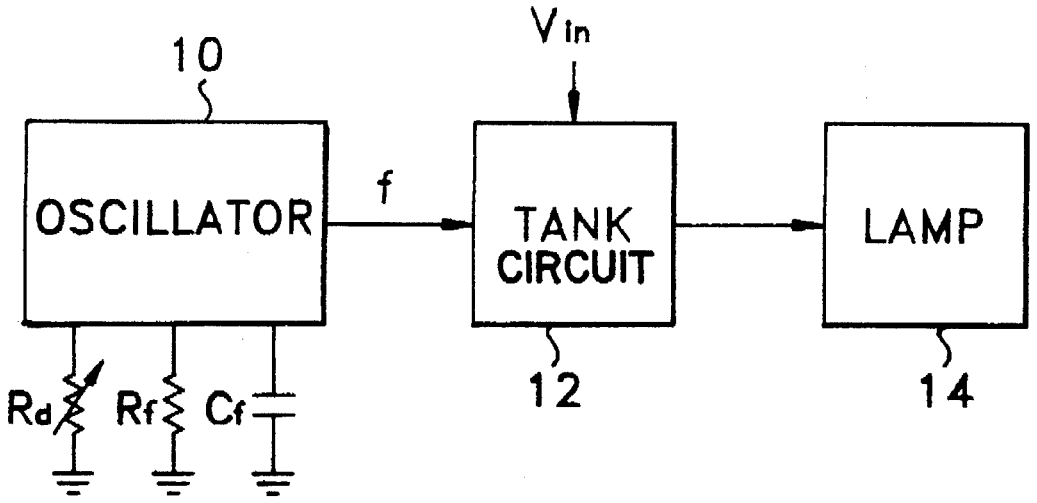
FIG. 1 (PRIOR ART)
FIG. 1 is a block diagram of a conventional dimming control cirucit.
Figure 2:
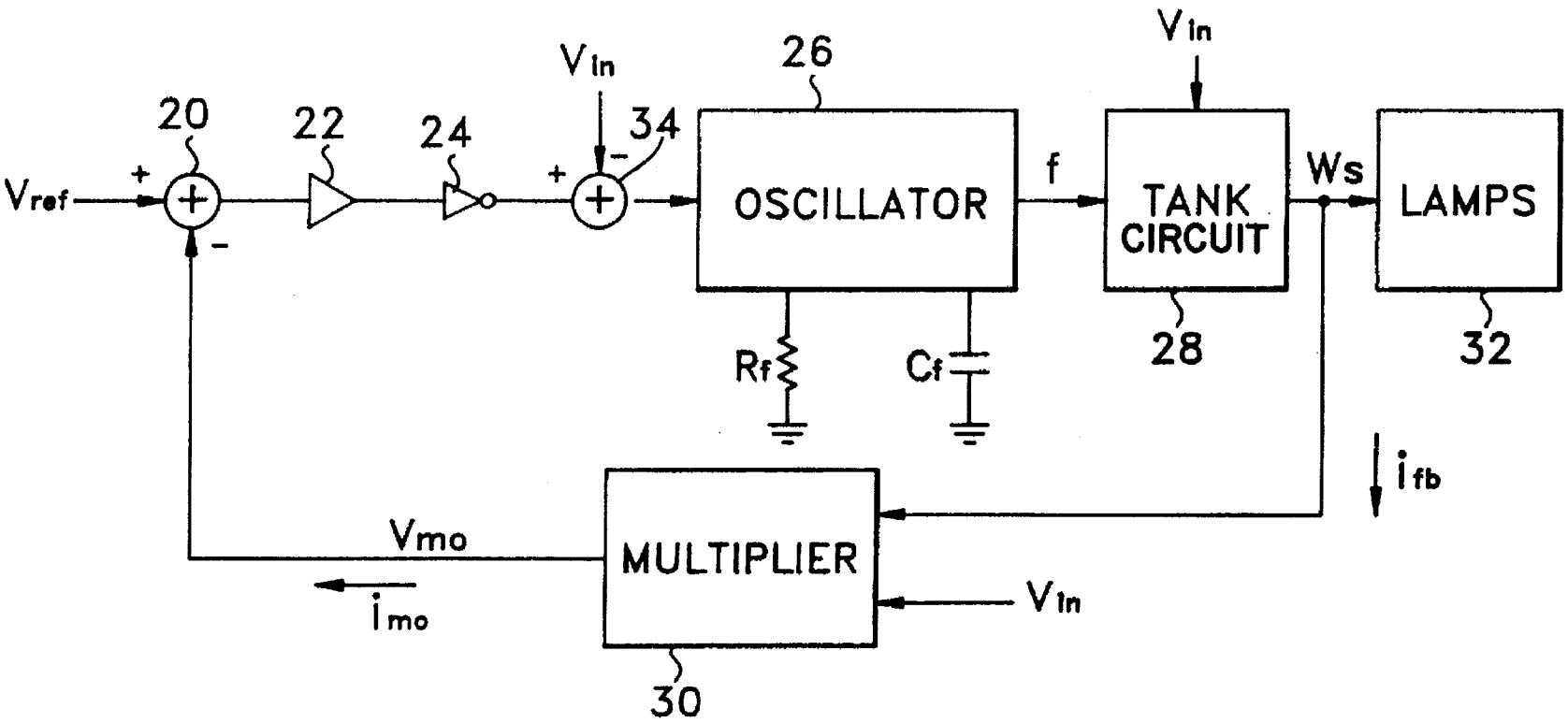
FIG. 2 is a block diagram of a feedback dimming control circuit according to an embodiment of the present invention.

Referring to FIG. 2, the feedback dimming control circuit of the present invention comprises of a multiplier 30 receiving and multiplying a feedback current $i_{fb}$ and an input voltage $V_{in}$; a first subtractor 20 for generating an error signal by subtracting an output voltage $V_{mo}$ provided by multiplier 30 from a reference voltage $V_{ref}$; an error amplifier 22 amplifying the error signal from first subtracter 20; an inverter 24 inverting the output of error amplifier 22; a second subtractor 34 subtracting an input voltage $V_{in}$ from the output of inverter 24; an oscillator 26 receiving the output of second subtracter 34, generating an oscillating signal having a period determined by a parallel RC combination of a dimming resistor $R_f$ and a capacitor $C_f$, and generating a frequency-divided portion f of the oscillating periodic signal as an output signal; a tank 28 provided with input voltage $V_{in}$ and resonating in response to the output signal from oscillator 26 to generate feedback current $i_{fb}$ and a lamp operating power supply $W_s$. A plurality of lamps 32 receive the output of tank 28.

In operation, multiplier 30 receives and multiplies feedback current $i_{fb}$ from tank 28 and input voltage $V_{in}$ to generate a multiplier output voltage $V_{mo}$. Output voltage $V_{mo}$ is subtracted from reference voltage $V_{ref}$ to produce an error signal applied to amplifier 22. The received error signal is amplified by error amplifier 22, inverted by inverter 24, and applied to second subtracter 34. Second subtracter 34 subtracts input voltage $V_{in}$ from the output of inverter 24, and applies the resulting difference signal to oscillator 26. The resulting output from oscillator 26 is applied to tank 28, and the output of tank 28 is simultaneously input to multiplier 30 as feedback current ifb and to lamps 32 as lamp operating power supply $W_s$.

Therefore, feedback current $i_{fb}$ is controlled by the resonating frequency of tank 28 based on frequency f output from oscillator 26. Thus, optimum dimming control is achieved through a feedback loop, so that constant light luminance can be maintained in spite of changes in load conditions or the input voltage. Also, reference voltage $V_{ref}$ may be varied in order to change the lamp operating power ($W_s$) by sensing a change in the number of lamps through a separate feedback control circuit. The level of reference voltage $V_{ref}$ is changed according to the number and/or size of lamps 32. When the number of lamps provided is n, for example, the reference voltage to determine the lamp operating power supply $W_s$ might be $n \times V_{ref}$.

Figure 3:
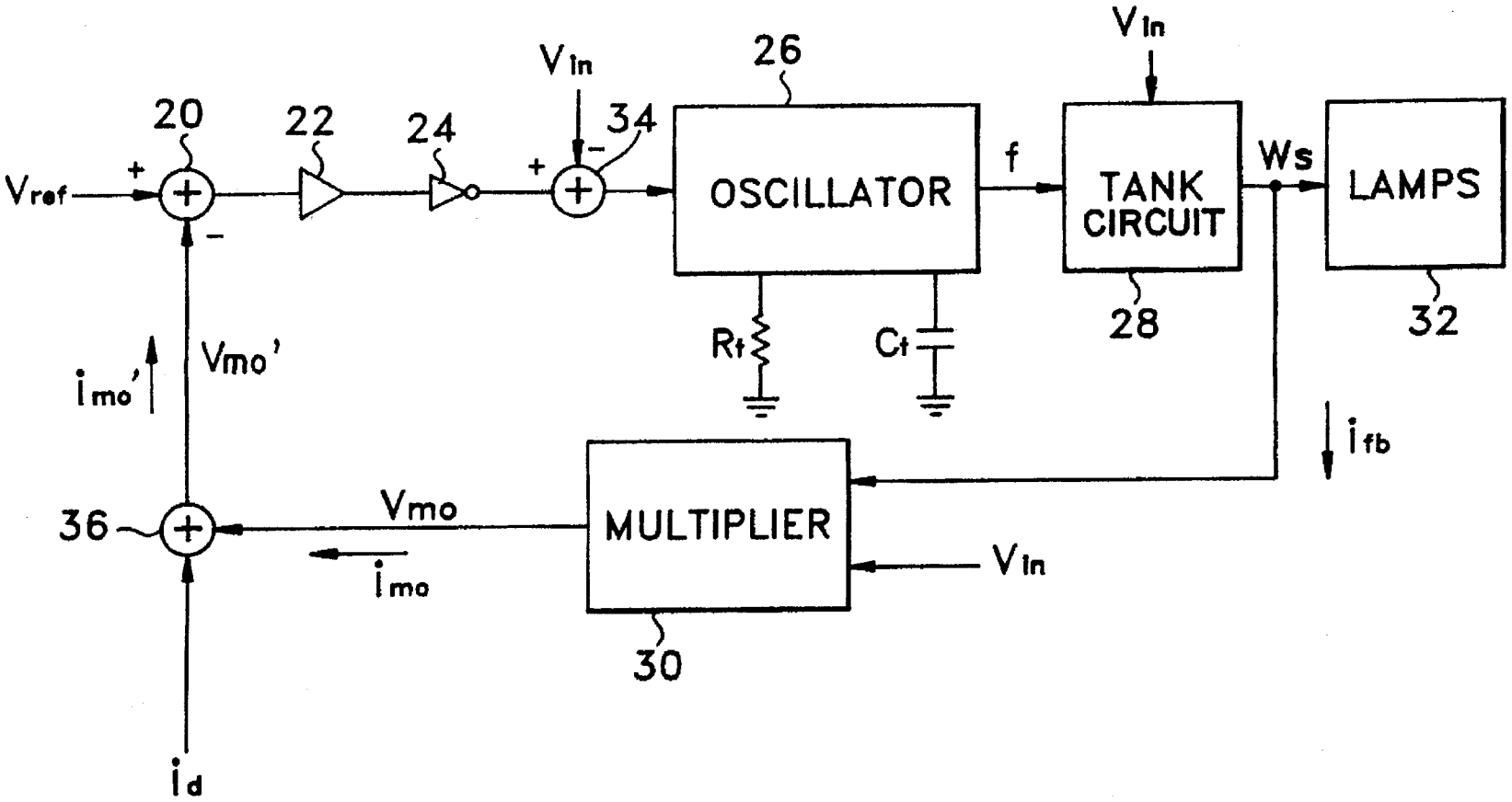
FIG. 3 is a block diagram of a feedback dimming control circuit according to another embodiment of the present invention.

FIG. 3 is a block diagram of a feedback dimming control circuit according to another embodiment of the present invention in which the dimming current depends on the number of lamps. The feedback dimming control circuit of FIG. 3 is identical to that of FIG. 2 in structure, except that in the former, an adder 36 is additionally provided between multiplier 30 and first subtracter 20, having one input port supplied with the multiplier output current $i_{mo}$ and the other input port receiving a dimming current $i_d$ from a separate control circuit (not shown). The output of adder 36 is applied to the subtracting port of first subtracter 20, as output voltage $V_{mo}'$ which can be defined thus:

$$V'_{mo}=i_{mo}'\times Z_o \quad (1)$$

wherein $Z_o$ is the output impedance of multiplier 30, and $i_{mo}'$ is the output current of adder 36 Here, output current $i_{mo}'$ is expressed as $$i_{mo}'=i_{mo}+i_d$$

wherein $i_d$ is dimming current. Therefore, $$i_{mo}=i_{mo}'-i_d \quad (2)$$

Thus, multiplier gain $G_m$ , considering dimming current $i_d$, is determined by $$G_m=\frac{i_{mo}Z_o}{V_{in}i_{fb}} \quad (3)$$

By simple manipulation of equation (2), multiplier output current $i_{mo}$ is decreased by an amount equal to dimming current $i_d$. Then, assuming a constant source voltage ($V_{in}$) in equation (3), the feedback current ifb should be reduced in order to obtain a constant multiplier gain $G_m$.

Meanwhile, lamp operating power Ws is given by $$Ws=i_{fb}\times V_{in} \quad (4)$$

Here, lamp luminance is proportional to lamp operating power Ws, and the decrease of feedback current $i_{fb}$ implies a decrease in lamp output. Thus, the operation of the circuit of FIG. 3 can be described, based on equations (1) to (4), as follows.

As dimming current $i_d$ increases, the output current $i_{mo}$ of multiplier 30 decreases, and when multiplier output current $i_{mo}$ decreases, feedback current $i_{fb}$ also decreases. Accordingly, lamp operating power Ws decreases, thereby decreasing the light output. That is, if dimming current $i_d$ is to have a constant value, lamp operating power Ws should be decreased.

However, the dimming operation is not a simple matter when a plurality of lamps are involved. The dimming current $i_d$ of a two-lamp feedback dimming control circuit is twice that of a one-lamp feedback dimming control circuit, as is the case with reference voltage $V_{ref}$. Therefore, assuming the dimming current for one lamp is $i_d$, the dimming current for two lamps should be $2i_d$. For example, when 10% dimming is calculated to be 6.4 W for a two-lamp case which draws 64 W, the same 10% dimming is calculated to be 3.2 W for the one-lamp case, i.e., one which draws 32 W. Thus, with an equal dimming rate for both the one lamp and two lamps, the former case has half the dimming current of the latter. As shown by this example, 5% dimming in the two-lamp case is equal to 10% dimming in the one-lamp case. The dimming current must be a double differential product in order to provide equal dimming for both of the foregoing exemplary cases.

Preferably, adder output voltage $V_{mo}'$ is set equal to reference voltage $V_{ref}$. Thus, if it is assumed that adder output voltage $V_{mo}'$ is equal to reference voltage $V_{ref}$, and it is determined that one-lamp reference voltage $V_{ref}$ is 0.3 V and two-lamp reference voltage $V_{ref}$ is 0.6 V, the following conditions can be reached, since the dimming is ultimately for controlling adder output voltage $V_{mo}'$ which is subtracted from reference voltage $V_{ref}$. That is 10% of two-lamp $V_{ref}$ 0.6 V is 0.06 V, and 10% of one-lamp $V_{ref}$ 0.3 V is 0.03 V. Accordingly, 10% of two-lamp dimming power is 6.4 W, and 10% of one-lamp dimming power is 3.2 W.

The above conditions can be described as follows, to obtain the rate of change for dimming current $i_d$. In designing multiplier 30, assuming that adder output voltage $V_{mo}'$ is set for a one-lamp case and a two-lamp case as above (i.e., to 0.3 V and 0.6 V, respectively), the multiplier output currents $i_{mo}(1)$ and $i_{mo}(2)$ are determined as 12.5 μA and 25.0 μA, based on the following equations $$0.3\ V=Z_o\times i_{mo}(1) \quad (5)$$

$$0.6\ V=Z_o\times i_{mo}(2) \quad (6)$$

wherein $Z_o$=24 KΩ, i.e., the output impedance of multiplier 30. Then, assuming each case is given a 10% dimming changing rate, dimming currents $i_d(1)$ and $i_d(2)$ can be calculated by $$0.3\ V-0.03\ V=24\ K\Omega[i_{mo}(1)+i_d(1)] \quad (7)$$

$$0.6\ V-0.06\ V=24\ K\Omega[i_{mo}(2)+i_d(2)] \quad (8)$$

From equations (7) and (8), dimming currents $i_d(1)$ and $i_d(2)$ are determined as −1.25 μA and −2.5 μA, respectively. As a result, the control of the dimming current for a constant dimming rate for the one- and two-lamp cases can be achieved when the two-lamp dimming current is twice as large as the one-lamp dimming current.

Therefore, the present invention can also be applied to the lighting of a plurality (n) of lamps, utilizing the above circuit construction. That is, when a plurality of lamps (expressed as n lamps) are to be lit, proper dimming is achieved by applying a reference voltage having a value of $nV_{ref}$ to the input port of first subtracter 20 and applying a dimming current having a value of nid to the input port of adder 74, as demonstrated in equations (7) and (8).

Accordingly, the feedback dimming control circuit of the present invention has an advantage in that proportional dimming can be performed when applied to plural lamp lighting requirements, and constant light luminance can be maintained despite changes in input voltage or load conditions.

The foregoing embodiments have been given by way of example. The present invention is not limited to these exemplary embodiments, but is defined by the following claims.

What is claimed is:

1. A feedback dimming control circuit for controlling the luminance of a plurality of lamps, the circuit comprising:

a multiplier receiving and multiplying a feedback signal and an input voltage to generate a first output signal;

a first subtracter generating an error signal by subtracting the first output signal from a reference voltage;

a second subtracter subtracting a signal responsive to the error signal from the input voltage to generate a second output signal;

an oscillator generating a periodic signal in response to the second output signal; and, a tank resonating in response to the periodic signal, generating the feedback signal, and supplying power to the plurality of lamps.

2. The feedback dimming control circuit of claim 1, further comprising:

an error signal amplifier receiving and amplifying the error signal from the first subtracter; and an inverter inverting the amplified error signal and providing an inverted amplified error signal to the second subtracter.

3. The feedback dimming control circuit of claim 2, further comprising:

an adder summing an applied dimming signal and the first output signal;

wherein the first subtracter generates the error signal by subtracting an output siqnal from the adder from the reference voltage.

4. The feedback dimming control circuit of claim 3, wherein the dimming signal varies according to a change in the number of lamps in the plurality of lamps, such that luminance control of the plurality of lamps is maintained.

5. The feedback dimming control circuit of claim 1, wherein the reference voltage increases proportionally with an increase in the number of lamps in the plurality of lamps.

* * * * *